United States Patent [19]

Lemaitre

[11] 4,395,853

[45] Aug. 2, 1983

[54] SELF-SUPPORTING ROOF FOR BUILDINGS, COMPOSED OF MODULAR ELEMENTS

[75] Inventor: Bernard Lemaitre, Caen, France

[73] Assignee: Batiroc, Villers-la-Montagne, France

[21] Appl. No.: 123,471

[22] Filed: Feb. 21, 1980

[30] Foreign Application Priority Data

Feb. 26, 1979 [FR] France ..... 79 04880

[51] Int. Cl.[3] ..... E04B 7/12; E04C 2/26; E04C 2/38

[52] U.S. Cl. ..... 52/18; 52/309.11; 52/404; 52/796; 52/809

[58] Field of Search ..... 52/404, 18, 796, 809, 52/309.11, 86, 90; 220/445

[56] References Cited

U.S. PATENT DOCUMENTS 2,407,252 9/1946 Closs ..... 52/86

2,419,149 4/1947 Lodwig ..... 52/404

*Primary Examiner*—John E. Murtagh

*Attorney, Agent, or Firm*—Holman & Stern

[57] ABSTRACT

A self-supporting roof for buildings, composed of modular elements each comprising an outer wall, a layer of heat insulating material, an inner wall carried by the outer wall and of the same form to support the insulating layer, and stiffening frame members secured to the outer wall wherein the inner wall is also rigidly secured to said frame members so as to form with the outer wall a unitary structure vis-à-vis the efforts.

2 Claims, 9 Drawing Figures

SELF-SUPPORTING ROOF FOR BUILDINGS, COMPOSED OF MODULAR ELEMENTS

FIELD OF THE INVENTION

The present invention relates to a self-supporting roof, particularly for industrial buildings, formed by wide-span modular elements.

DESCRIPTION OF THE PRIOR ART

French Pat. No. 1 558 925 discloses the use of modular roof elements comprising an outer self-supporting shell or wall providing the element with mechanical strength, a layer of heat insulating material, and an inner wall supporting the insulating layer and carried by the outer wall, the latter further being stiffened by frame members disposed along its slope. The roof elements are prefabricated in the factory, the work remaining to be done on site consisting essentially in positioning the elements and in assembling them to form the whole roof.

BRIEF SUMMARY OF THE INVENTION

The present invention improves the roof element of the above type by using a likewise inner wall and rigidly connecting it to the outer wall via said frame members, so as to take advantage of the inherent rigidity of the inner wall to increase the bending moment of the roof element. In the roof element according to the invention, the inner wall in addition to its conventional function of support for the insulating layer, assists in improving the strength of the roof element.

The ends of the frame members are preferably fixed to compression bars disposed longitudinally of the walls. The compressive strength is thus increased at the ends of the walls and the transmission of the efforts between the outer and inner walls, and therefore the overall strength of the roof element, are reinforced.

In one embodiment, the frame members are tubes of rectangular section which are filled with a heat-insulating material, for example a synthetic foam product, to prevent the frame members from forming thermal bridges.

In another embodiment, the frame members are formed by spaced profiles fixed respectively to the inner and outer walls, between which spacer members are fixed at intervals.

The roof elements according to the invention may take different forms: the walls may thus be formed by curved ribbed steel sheets or, in an alternative embodiment, the walls may be trapezoidal in form. In this case, the outer wall will advantageously comprise two identical, symmetrically disposed elements, fixed to each other directly or via a skylight, and the inner wall will comprise two elements identical to the afore-mentioned elements.

The invention will be more readily understood on reading the following description with reference to the accompanying drawings, in which:

DETAILED DESCRIPTION

Figure 1:
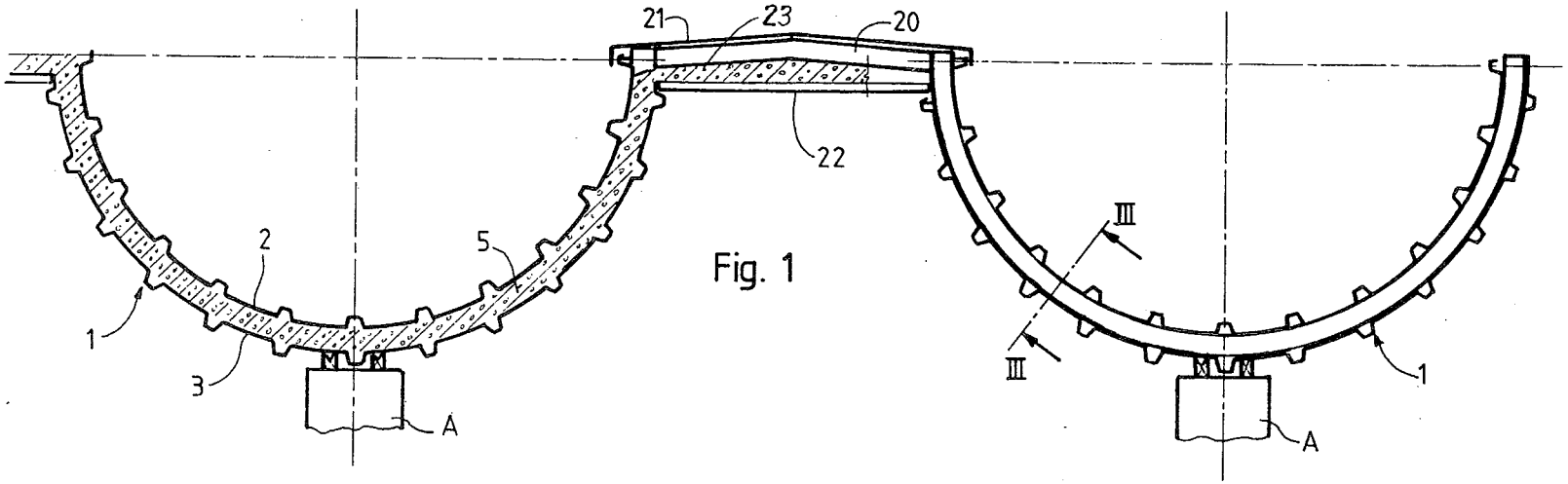
FIG. 1 shows, partially in cross-section, the structure of a self-supporting roof according to the invention, formed by curved elements.

Referring now to the drawings, FIG. 1 shows two elements 1 of a self-supporting roof for an industrial building.

Each element is substantially semi-circular in cross-section, with a width of about 2 meters, and a length of as much as 30 meters. The elements are supported at their ends by supports symbolised at A, which may be constituted by the front walls of the building.

Figure 5:
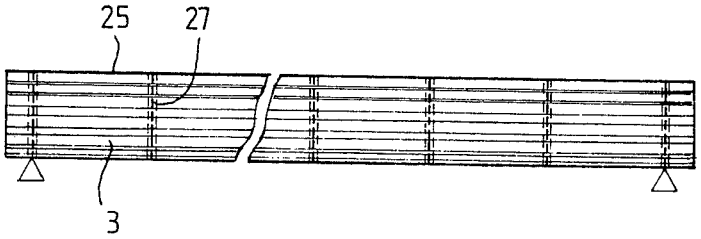
FIG. 5 shows the roof element of FIG. 4, in side view.
Figure 6:
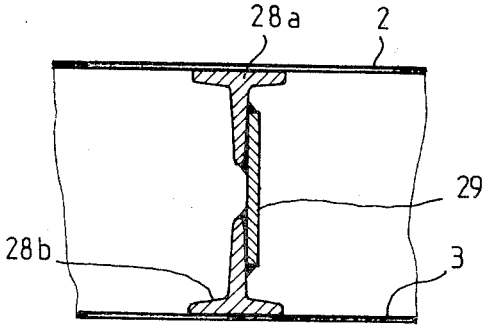
FIG. 6 is a detailed section showing the shape of a frame element.

Each element comprises an outer wall 2 and an inner wall 3 curved in identical manner and with the same mechanical strength. Between these walls are disposed, at regular intervals in the longitudinal direction, transverse frame members following the shape of the walls (see FIG. 5 for this arrangement) and one of which has been shown in section in FIG. 2*a*.

Figure 2B:
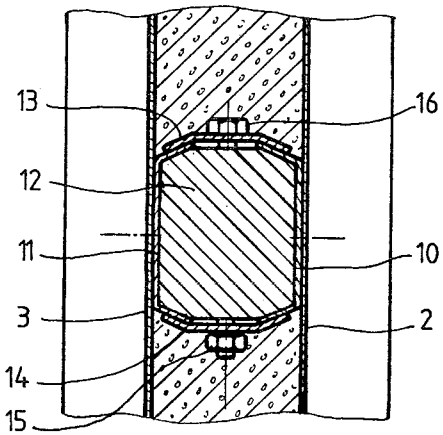
FIG. 2*b* shows a modification with respect to the embodiment of FIG. 2*a;*
Figure 2A:
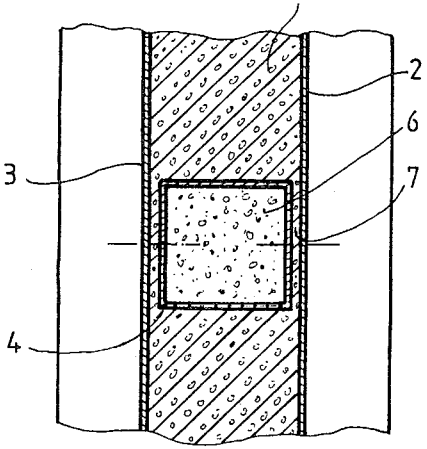
FIG. 2*a* is a partial view in cross section along III—III of FIG. 1, showing the form of a frame member.

The frame member 4 of FIG. 2*a* is a tube of square section which is fixed, on the one hand, to the outer wall 2 and, on the other hand, to the inner wall 3 by any suitable means, preferably by self-boring and self-tapping screws shown symbolically by the dashed and dotted lines.

Between the walls 2 and 3 is placed a layer of heat insulating material 5, for example glass wool. The frame members 4 are themselves filled with a heat insulating material 6, for example polyurethane foam formed in situ, to avoid the frame members 4 forming thermal bridges. To improve insulation, a layer of glass wool is further interposed between the frame member and the walls, when the element is being manufactured, this layer then being crushed when the fixation as indicated by reference 7 is effected.

FIG. 2*b* shows a modification with respect to the embodiment of FIG. 2*a*, in which irons 10, 11 having spaced apart flanges are respectively fixed to the walls 2 and 3, and between the irons 10 and 11, pads 12 of rigid, thermally insulating material, for example wood or rigid plastics material are placed at regular intervals. The connection between the irons 10 and 11 is achieved by clamping elements 13, 14 enclosing the pads 12 and connected by tightening of a nut 15 on a bolt 16.

In the embodiment of FIG. 1, the walls 2 and 3 are constituted by troughs made of steel, i.e. of ribbed steel sheets. These troughs are commercially available and each wall will be formed by one or more of them, according to the width required. If a wall comprises a plurality of troughs, the connection will be achieved by overlapping the waves or ribs and securing the same by screws.

Figure 3:
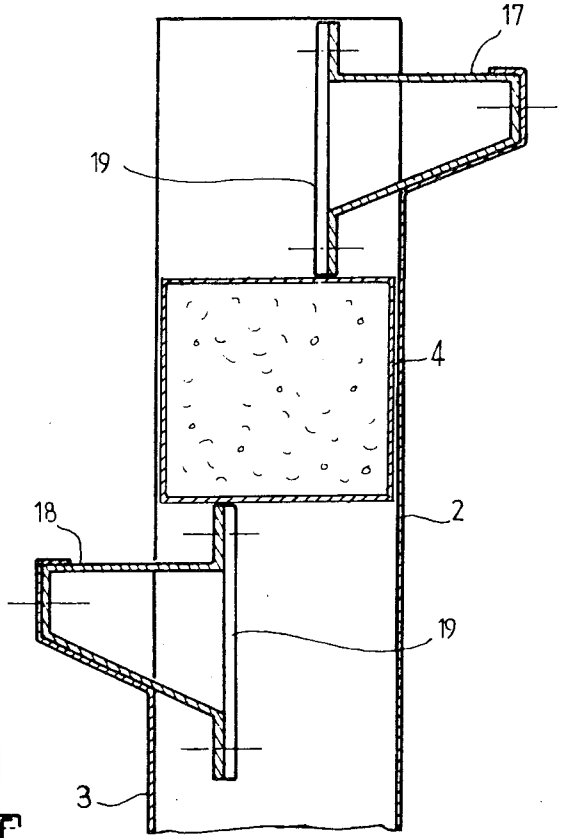
FIG. 3 is a schematic illustration, on a larger scale, of the end portion of a roof element according to FIG. 1.

To reinforce the compressive strength of the end portions of the roof element, longitudinal bars 17 are received in the last wave of the outer wall 2, as shown in FIG. 3, as well as longitudinal bars 18 received in the last wave of the inner wall 3. Each of these compression bars is placed between two consecutive frame members 4 and is secured by its ends on plates 19 welded on the frame members 4.

Connecting bars 20 forming spacers are disposed between two adjacent roof elements and fixed on the uncovered ends of the frame members 4. Above the connecting bars 20 is placed a water-tight ridge board 21 and under the bars 20 is located a sub-ceiling 22 supported by the upper face of the compression bars 18. A layer 23 of heat insulating material is placed on the sub-ceiling 22.

A translucent skylight could also merely be placed between two adjacent roof elements.

The advantages of the roof according to the invention are as follows:

Due to the rigid connection established between the inner and outer walls by the frame members 4, and by the compression bars, the inner wall 3 contributes by its own strength to the rigidity of the roof, instead of forming a dead weight which the outer wall must support, as in the prior art mentioned hereinbefore. This enables the span of an element to be increased or, for a given span, the thickness of the walls to be reduced.

On the other hand, the roof elements 1 are prefabricated in the factory and the only operations remaining to be carried out on the site are the positioning of the elements 1 on the support walls and the placing of the connecting bars, ridge board, etc. between the elements 1.

Figure 4:
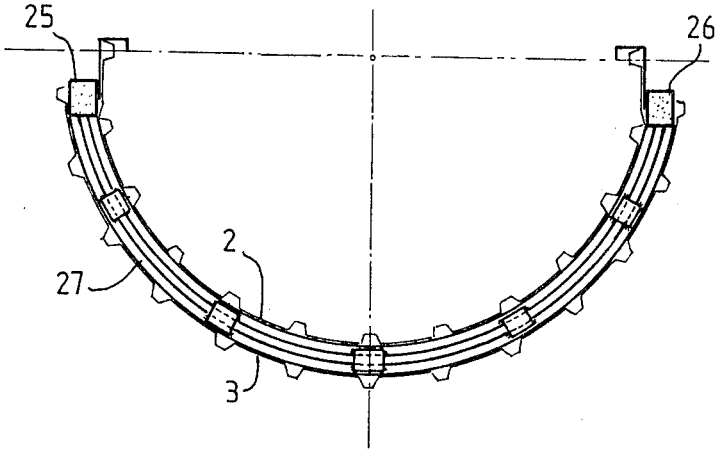
FIG. 4 shows in section a curved roof element according to a modified embodiment.

FIG. 4 shows a preferred modified embodiment in which two compression bars have been provided, constituted by tubes 25,26 of square section extending continuously over the whole length of the roof element, instead of being placed between the frame members in the waves of the walls, as shown in FIG. 3. In this modification, all the frame members 27 have their ends fixed respectively to bars 25, 26.

Such a modification improves the transmission of the efforts between the walls by the compression bars. The bars 25,26 are, like the tubular frame member of FIG. 2*a*, furthermore filled with a heat insulating foam formed in situ.

The frame members are also different in structure from what has been described hereinbefore. They are each formed by two T-irons 28*a*, 28*b* respectively fixed to the outer wall and to the inner wall, preferably by means of self-tapping screws (not shown). The irons 28*a*, 28*b* are spaced apart and connected at intervals by metal pieces 29 welded on the webs of the irons 28*a*, 28*b*. Such an embodiment presents the advantage of being very easy to manufacture.

Figure 7:
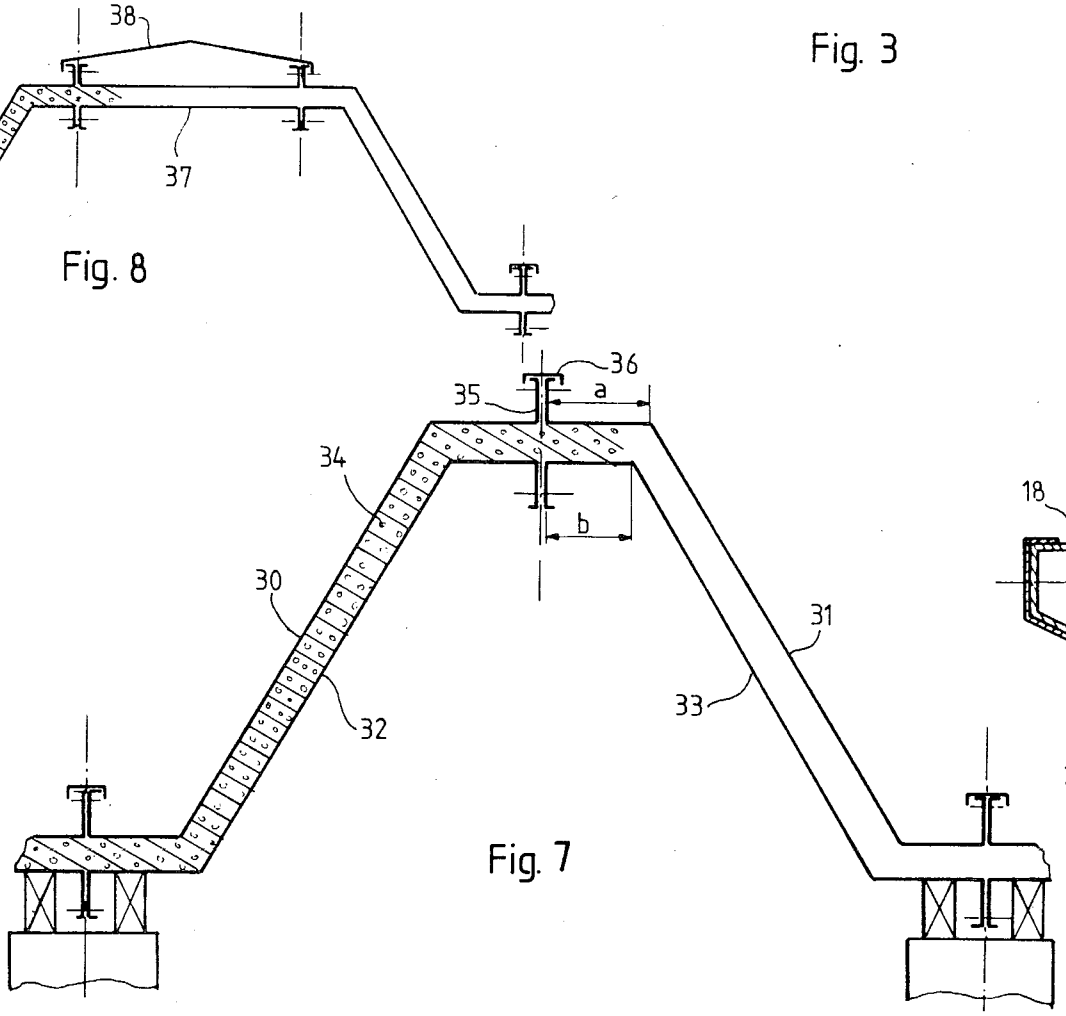
FIG. 7 shows a partial cross-sectional view of a roof element in trapezoidal form.

FIG. 7 shows a roof element designed along the same principle, but in trapezoidal form. As in the embodiments described previously, the inner wall is rendered mechanically fast with the outer wall by frame members (not shown) generally trapezoidal in form.

The outer wall is formed by two half-walls 30 and 31 of identical shape, assembled by flanges 35 formed at the ends. The half walls 30, 31 each comprise an oblique part forming the slope, extended by portions parallel to each other which form the horizontal parts of the roof and which have different lengths a and b.

The inner wall is also formed by two half-walls 32 and 33, which have exactly the same shape as the half-walls 30, 31 forming the outer wall, but which are turned upside down with respect thereto, the portion of length b of the half-wall 32 (or 33) being opposite the portion of length a of the half wall 30 (or 31). A space of uniform width is thus made between the inner wall and the outer wall to receive the heat insulating material 34, whilst simplifying manufacture and storage since a single basic element is used for both walls.

The connection with the adjacent elements is effected by bolting the flanges 35, and coverings 36 are placed at the junctures to achieve tightness.

Figure 8:
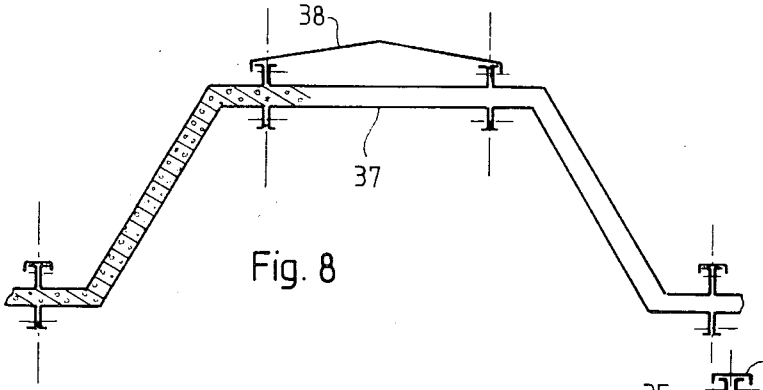
FIG. 8 shows a modification with respect to the element of FIG. 7.

FIG. 8 shows a modification in which bars 37 connect the halves of elements, said bars being fixed to the frame members, and a translucent skylight 38 covers the space thus made between the halves of elements.

What I claim is:

1. A self-supporting roof for buildings composed of modular elements each comprising a longitudinally extending outer wall and an inner wall extending parallel with respect to each other, stiffening frame members disposed between said walls at spaced intervals and fixed to said walls to form a unitary structure, thermal insulating material disposed between said walls and supported by said inner wall, said stiffening frame members comprising spaced sections fixed respectively to said inner and outer walls and being in the form of irons having diverging flanges, spacer pads made of insulating material fixed at intervals between said irons, clamping members positioned on either side of said pads against the outside of said flanges and means to fasten said clamping members together to clamp said flanges and irons therebetween.

2. A roof as claimed in claim 1, wherein the walls are curved ribbed sheets and the frame members are in the form of arcs.

* * * * *